US009902530B2

(12) United States Patent
Smith et al.

(10) Patent No.: US 9,902,530 B2
(45) Date of Patent: Feb. 27, 2018

(54) CLOSURE

(75) Inventors: Mark Smith, Cheltenham (GB); Rodney Druitt, Cheltenham (GB)

(73) Assignee: Creanova Universal Closures, Ltd., Tewkesbury (GB)

( * ) Notice: Subject to any disclaimer, the term of this patent is extended or adjusted under 35 U.S.C. 154(b) by 0 days.

(21) Appl. No.: 13/976,296

(22) PCT Filed: Jan. 12, 2012

(86) PCT No.: PCT/EP2012/050458
§ 371 (c)(1),
(2), (4) Date: Jun. 26, 2013

(87) PCT Pub. No.: WO2012/095501
PCT Pub. Date: Jul. 19, 2012

(65) Prior Publication Data

US 2013/0270272 A1 Oct. 17, 2013

Related U.S. Application Data

(60) Provisional application No. 61/432,802, filed on Jan. 14, 2011.

(51) Int. Cl.
*B65D 41/34* (2006.01)
*B65D 41/04* (2006.01)

(52) U.S. Cl.
CPC ..... *B65D 41/34* (2013.01); *B65D 41/0414* (2013.01); *B65D 41/3447* (2013.01); *B65D 2101/0023* (2013.01); *B65D 2251/023* (2013.01)

(58) Field of Classification Search
CPC ..... B65D 41/3428; B65D 41/04; B65D 2251/023; B65D 41/34; B65D 41/0414; B65D 41/3447; B65D 2101/0023
USPC ..... 215/252, 305, 307, 329, 343, 344, 337
See application file for complete search history.

(56) References Cited

U.S. PATENT DOCUMENTS 2,058,297 A * 10/1936 Carvalho ..... B65D 41/04 215/337
3,061,132 A * 10/1962 Geddes ..... B65D 41/0442 215/262
4,489,845 A 12/1984 Aichinger et al.
5,050,753 A * 9/1991 Trump et al. ..... 215/252
(Continued)

FOREIGN PATENT DOCUMENTS

DE 3233806 A1 * 3/1984
EP 0 076 778 4/1983
(Continued)

OTHER PUBLICATIONS

Machine generated English translation of DE 32 33 806, from Espacenet. Jun. 23, 2015.*
(Continued)

*Primary Examiner* — James N Smalley
(74) *Attorney, Agent, or Firm* — Pauley Erickson & Kottis

(57) ABSTRACT

The present disclosure relates to a closure, especially a closure for packages for liquids such as beverages. In particular the invention relates to a closure for containers for carbonated liquids such as soft drinks. The closure comprises an outer shell with a reduced weight and a sealing means which actively compensates the deformation of the outer shell to avoid loss of performance.

18 Claims, 4 Drawing Sheets

(56) References Cited

U.S. PATENT DOCUMENTS

| | | | | |
|---|---|---|---|---|
| 5,197,620 | A * | 3/1993 | Gregory | B65D 51/1688 215/307 |
| 6,089,390 | A * | 7/2000 | Druitt et al. | 215/252 |
| 6,695,161 | B2 | 2/2004 | Kano et al. | |
| 6,874,648 | B2 | 4/2005 | Willingham et al. | |
| 7,014,055 | B2 | 3/2006 | Kano et al. | |
| 7,575,121 | B2 | 8/2009 | Ooka et al. | |
| 7,607,547 | B2 | 10/2009 | Kumata et al. | |
| D613,162 | S | 4/2010 | Druitt | |

FOREIGN PATENT DOCUMENTS

| | | |
|---|---|---|
| EP | 1 914 174 | 4/2008 |
| JP | 57133851 | 8/1982 |
| JP | 9150846 | 6/1997 |
| JP | 10-35699 | 2/1998 |
| JP | 2000-79954 | 3/2000 |
| JP | 2000 109105 | 4/2000 |
| JP | 2000-159250 | 6/2000 |
| JP | 2004-352261 | 12/2004 |
| JP | 2005-320055 | 11/2005 |
| JP | 2007 145341 | 6/2007 |
| WO | WO 89/12584 | 12/1989 |
| WO | WO 94/02371 | 2/1994 |
| WO | WO 99/03746 | 1/1999 |
| WO | WO 00/56615 | 9/2000 |
| WO | WO 00/56616 | 9/2000 |
| WO | WO 01/87725 A1 | 11/2001 |
| WO | WO 03/011699 A1 | 2/2003 |
| WO | WO 03/022701 A1 | 3/2003 |
| WO | WO 2005/039996 | 5/2005 |
| WO | WO 2006/024550 A1 | 3/2006 |
| WO | WO 2006/024656 A1 | 3/2006 |
| WO | WO 2006/097151 | 9/2006 |
| WO | WO 2006/097151 A2 | 9/2006 |

OTHER PUBLICATIONS

International Search Report dated Mar. 20, 2012 issued in corresponding International Patent Application No. PCT/EP2012/050458.

* cited by examiner

CLOSURE

CROSS REFERENCE TO RELATED APPLICATIONS

The present application is a 35 U.S.C. § 371 National Phase conversion of PCT/EP2012/050458, filed Jan. 12, 2012, which claims benefit of U.S. Provisional Application No. 61/432,802, filed Jan. 14, 2011 the disclosures of which are incorporated herein by reference. The PCT International Application was published in the English language.

FIELD OF THE INVENTION

The invention relates to a closure, especially a closure for packages for liquids such as beverages. In particular the invention relates to a closure for containers for carbonated liquids such as soft drinks, but is well adapted to seal other containers such as glass or PET containers with contents at above or below atmospheric pressure or having gaseous components or requiring a hermetic seal.

BACKGROUND OF THE INVENTION

Screw cap closures (closures) are well known from the prior art and are a subject of continuous optimization. One attempt is to reduce the weight of the closure because the major share of the price is caused by the material used to make the closure. Therefore, in other words, reduction of the material used to make the closure means a reduction of the price of the closure. Furthermore, less material consumption results in an improved environmental compatibility.

From the same inventor several patent applications are known in the field of the invention, which are primarily directed to sealing technology and/or closures. Examples are WO06024550, WO06024656, WO06097151, WO03022701, WO0056615, WO0056616, WO9903746, WO9402371, WO8912584, U.S. Pat. No. 6,874,648 and USD613162.

EP0076778 of Albert Obrist AG was filed in 1982 and is directed to a closure cap made of plastics material, which has a circular outer sealing lip having a thickness which continuously decreases versus its free end. The outer sealing lip is arranged in the region of the joint between an outer vertical skirt and a disc like top portion and points obliquely inwards. At its smallest diameter, the sealing lip has a rounded sealing portion. Below the sealing portion, the sealing lip is widened outwards in the manner of a funnel to receive a container opening. However, due to the obliged arrangement of the sealing lip, the sealing lip often tends to be distorted during application, especially crooked application onto a neck of a container. A further disadvantage consists in that, due to the inclined arrangement, this seal is relatively rigid and therefore not very good in adjusting in lateral direction.

U.S. Pat. No. 4,489,845 was filed in 1984 and assigned to Albert Obrist AG. U.S. Pat. No. 4,489,845 is directed to a screw-cap for closing a container opening. The cap has a sealing lip which is affixed to the cap top. The inner side-wall of the outer sealing lip has a diameter which is greater than the outer diameter of the container outer wall. A clamping device, which can be designed as an inner seal, creates a contraction of the cap top when the screw-cap is screwed onto the container due to deformation of the outer shell of the closure, by which means the sealing lip shall be pressed against the container mouth. In this manner the sealing lip is only pressed radially against the container mouth during the course of the screwing-on process. Thereby, over-stretching and damage to the material of the sealing lip shall be prevented. In an engaged position the sealing lip engages around the upper outer rim of the neck of a container opening. One disadvantage is that the described deformation of the closure is related to extensive operating forces. A further disadvantage consists in that the outer shell tends to break due to extensive stress and deformation (stress cracking), which results in complete failure of the closure and loss of the product.

WO03011699 filed in 2002 by Bericap is directed to a closure cap comprising an internal sealing skirt, which is substantially truncated and converges from the sealing skirt base towards the free end of the sealing skirt. The inside of the sealing skirt is designed to cooperate with the outside of the neck. The internal diameter of the sealing skirt towards its free end portion is designed smaller than the external diameter of the neck. As described, the closure can comprise an annular v-notch designed to improve attachment of a liner to the rim of the neck or contact between the liner and the rim.

Further patent publications showing several sealing technologies and/or closures are e.g. JP57133851, JP58073551, U.S. Pat. No. 4,489,845, U.S. Pat. No. 6,874,648, JP9150846, JP3872546, JP4392873, JP2000109105, JP4456681, U.S. Pat. No. 7,014,055, WO0187725, U.S. Pat. No. 6,695,161, JP4533597, WO05039996, JP4413071, U.S. Pat. No. 7,575,121, JP2007145341 or U.S. Pat. No. 7,607,547.

SUMMARY OF THE INVENTION

It is an object of the invention to provide a closure with a reduced weight, which can withstand internal pressure e.g. from carbonated soft drinks. It is a further object of the invention to provide a closure with improved performance, such as venting, removal torque and so forth.

The closure is foreseen to be used with standardized neck finishes as known from prior art. The standardized neck finishes comprise an outer peripheral surface with an external thread. The outer peripheral surface blends by an edge surface into an annular top surface, which forms the upper end of the container when it is standing upright. Between the annular top surface and the external thread an outer free surface extends over a length of approximately 1 mm to 3 mm of the neck, which is not covered by the thread and suitable for sealing purposes. Furthermore, the neck of the container comprises an in general cylindrical, inner peripheral surface adjacent to the annular top surface.

The object of the invention is solved by a closure which comprises a shell with reduced weight and which is foreseen to withstand internal pressure, e.g. resulting from a carbonated liquid. In general, saving of weight, i.e. reducing of material, is contradictory to capability to withstand internal pressure. The capability to withstand internal pressure is linked to a certain stiffness or rigidity of the closure, namely the outer shell of the closure to avoid unwanted deformation. Critical areas are namely the seal or the top deck of the closure. If the outer shell of the closure is not sufficiently stiff (rigid) or designed in a wrong way, the closure tends to deform and is therefore not capable to fulfill the required specifications. Namely at elevated temperatures and under internal pressure, insufficient closures tend to fail and are therefore not acceptable.

A closure according to the present invention is designed to have on the one hand a very low weight compared to closures known from prior art and on the other hand a high performance to withstand internal pressure. The design of the closure is based on a certain deformation tolerance, which allows the closure to deform under certain extreme conditions. The outer shell and the seal are thereby interacting with each other in a balanced manner. The seal is designed that it can adjust to the deformation of the outer shell such that within the specification no unwanted leaking or loss of pressure occurs.

A closure according to the present invention comprises a base with a disc like top portion and a therewith adjacent outer skirt with an internal thread or similar retaining means suitable to be engaged with the external thread of a neck finish as described above.

The closure may further comprise a tamper band attached to a lower free end of the outer skirt and integrally attached thereto by frangible bridges or similar means such as a thin web of material.

In a preferred embodiment, a closure according to the invention comprises a top deck and a therewith adjacent outer skirt. The outer skirt comprising on the inside a segmented thread, whereby between two in circumferential direction adjacent thread segments first channel-like recesses are arranged extending in an axial direction of the skirt. The channel-like recesses are arranged alternating with the rows of thread segments. On the outside of the skirt at least one second channel-like recess is arranged, which extends in the axial direction of the skirt. Said second recess is arranged radial outside to and aligned with at least two thread segments adjacent to each other in an axial direction of the closure. In general, the number of the first recesses on the inside and the rows of second recesses on the outside are equivalent with respect to each other. In a preferred embodiment, the at least one second recess on the outside of the skirt is arranged adjusted (symmetric) with respect to the adjacent thread segments on the inside of the skirt. If appropriate, third recesses are arranged between the second recesses. Thereby, the weight of the closure can be additionally reduced. Good results can be achieved when the number of rows of thread segments and first recesses is equivalent to 10-15 rows. Preferably, on the outside of each row of thread segments a second recess is arranged adjusted with respect to the thread segments at least in circumferential direction. The second recesses are preferably arranged coaxial to the rows of thread segments.

To compensate and balance the deformation of the outer shell, a sealing means is arranged on the inside of the closure, which has with respect to its cross-section an outer leg extending in general perpendicular from the top deck of the closure and being arranged such that the outer leg in an applied position of the closure on a neck finish interacts with an outer surface of the neck finish forming a first sealing area. The outer leg may be arranged pointing slightly radially inwardly, whereby the inner side wall of the outer leg is arranged at an angle $\alpha$ between 86° to 90° with respect to the top deck (horizontal direction; direction perpendicular to the closure axis). Depending on the field of application, the outer leg may comprise on the inside a bump arranged at the inner root of the outer leg next to the top deck. The bump is designed and arranged to interact with a rim surface and/or an annular end surface of the neck finish forming a second sealing area, whereby the bump seal is functionally separated from the outer leg by a notch. When the closure is applied onto a neck finish, the bump tends to deform significantly.

Very good results are achieved by a seal comprising blend, which interconnects the outer leg and the top deck. The blend thereby acts in applied position of the closure as a second sealing area. The blend is designed to provide a functional interaction between the outer leg and the second sealing area. A further advantage is that the blend does not deform as much as the bump and in general the deformation is reversible. When the closure is applied onto a neck finish, a rim surface of the neck finish presses onto the blend after a first sealing area between the outer leg and the outer surface of the neck finish has been established. The thereby resulting foreshortening of the blend causes that the outer leg is pulled inwardly in an increased manner, thereby improving the sealing performance of the outer leg.

BRIEF DESCRIPTION OF THE DRAWINGS

The herein described invention will be more fully understood from the detailed description given herein below and the accompanying drawings, which should not be considered limiting to the invention described in the appended claims. The drawings are showing:

DESCRIPTION OF THE EMBODIMENTS

Figure 1:
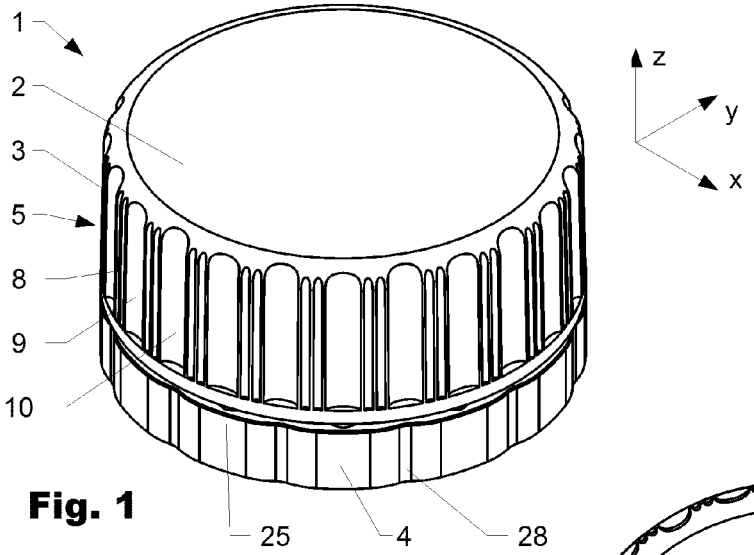
FIG. 1 A first embodiment of a closure according to the invention in a perspective view.
Figure 2:
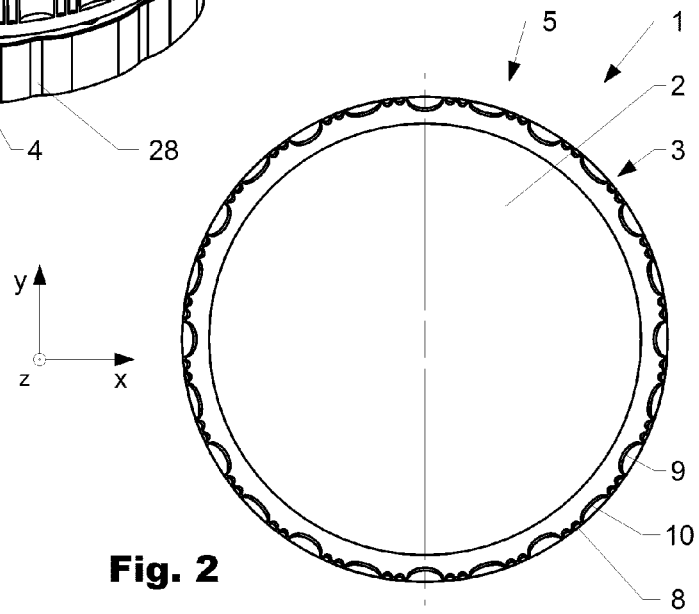
FIG. 2 The closure according to FIG. 1 in a top view.
Figure 3:
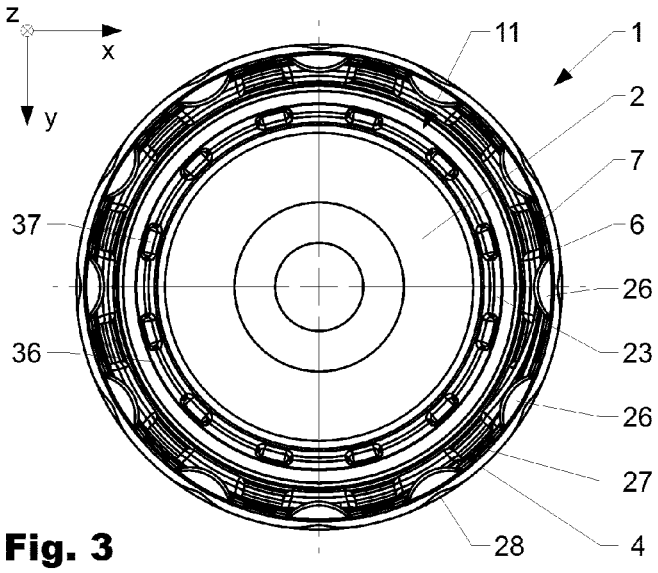
FIG. 3 The closure according to FIG. 1 in a bottom view.
Figure 4:
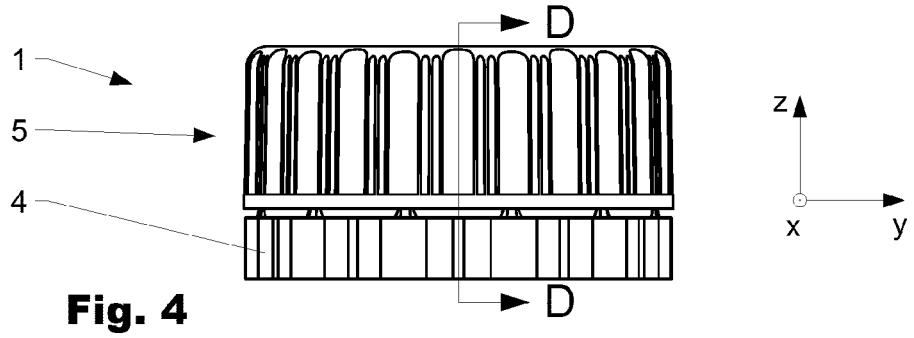
FIG. 4 The closure according to FIG. 1 in a side view.
Figure 5:
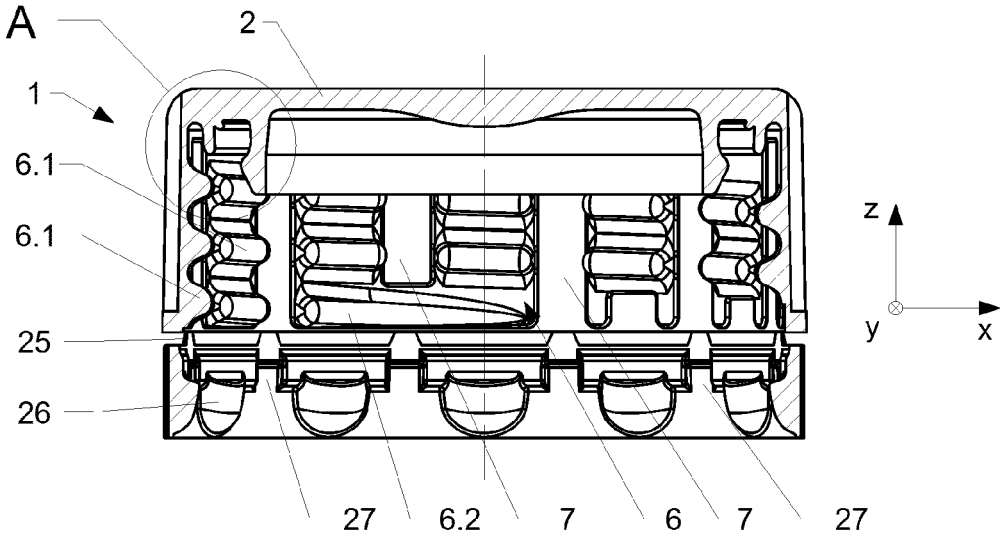
FIG. 5 The closure according to FIG. 1 in a section view along section line D-D.
Figure 6:
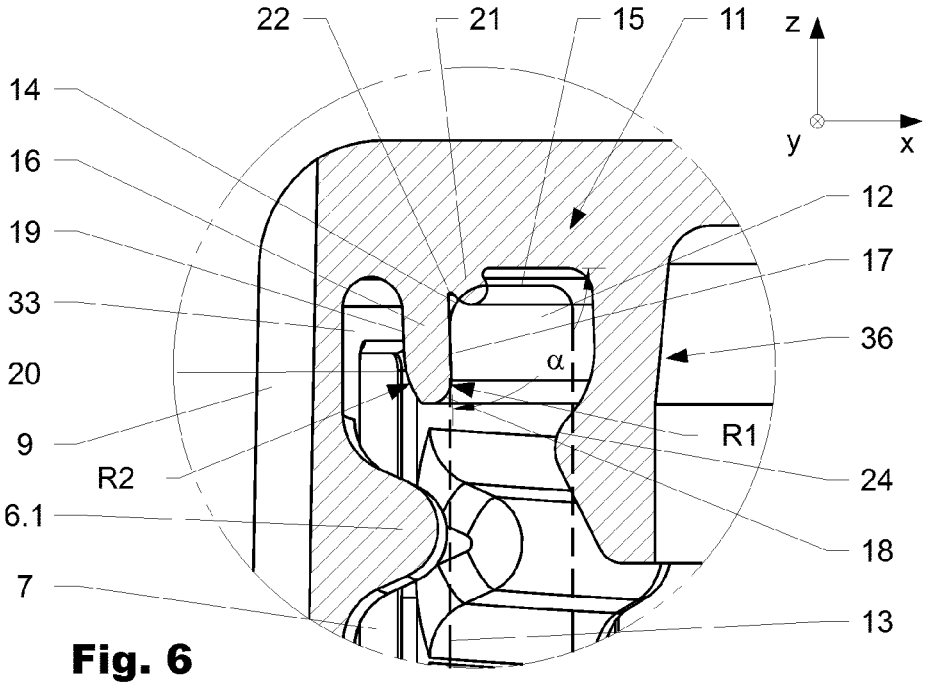
FIG. 6 Detail A of FIG. 5.

FIG. 1 shows a first embodiment of a closure 1 according to the invention in a perspective view. FIG. 2 shows the same closure 1 in a top view, FIG. 3 in a bottom view and FIGS. 4 and 7 in a side view. FIG. 5 shows a section view of the closure along section line D-D and FIG. 6 shows detail A according to FIG. 5 in a magnified manner. FIG. 8 shows a section view of the closure along section line E-E, FIG. 9 a section view along section line F-F and FIG. 10 a section view along section line G-G.

As it can be seen in FIG. 1, the closure 1 comprises a circular top deck 2 and a therewith adjacent in outer skirt 3. A tamper band 4 is interconnected to the lower free end of the outer skirt 3. A closure shell 5 consists out of the top deck 2 and the outer skirt 3.

As it can be seen in FIGS. 5 and 6, the outer skirt 3 comprises on the inside a thread 6, which consists out of thread segments 6.1. The thread 6 extends in the shown embodiment over a total angle of 765° (2¼ coils). Between two in circumferential (helical) direction adjacent thread segments 6.1, channel-like recesses 7 are arranged on the inside of the skirt 3 in a vertical direction (parallel to a closure axis z; vertical means in general vertical). The shown embodiment comprises in total twelve channel-like recesses 7, which are circumferentially evenly distributed between the thread segments 6.1. As it can be seen, the recesses 7 extend in axial direction at least across two in axial direction adjacent thread segments 6.1. By the evenly distributed and balanced arrangement of the thread segments 5.1 and the channel-like recesses 7, a balanced distribution of the load is achieved, which e.g. may occur due to internal pressure or the like.

The majority of the channel-like recesses 7 are extending over approximately 70-90% of the outer free length of the outer skirt 3. Only the recess 7 above the extended thread start segment 6.2 has a shorter length (see FIG. 5). The recesses 7 of the shown embodiments have an in general constant cross-section. If appropriate, the cross-section may vary over the length of the recess 7. If appropriate, the recesses 7 may have—instead of a straight design as shown—a curved, e.g. helical shape.

As best visible in FIGS. 1 and 2 the outer skirt 3 of the closure 1 comprises on the outside knurls 8, which are foreseen to increase the grip of the closure 1. In radial outside direction behind and aligned to the thread segments 6.1 channel-like second recesses 9 are arranged, which extend in axial direction of the closure having a first depth d1. The second recesses 9 on the outside and the first recesses 8 on the inside of the skirt 3 alternate with respect to each other in a circumferential direction. Intermediate to the second recesses 9 channel-like third recesses 10 are arranged having a second depth d2 compared to the second recesses 9. The third recesses extend in axial direction (z-direction) of the closure 1. The dept and the orientation of the recesses 8, 9, 10 may vary over their length, e.g. due to draft angle and/or design reasons. It has been found that the herein shown arrangement of smaller knurls, recesses 7, 9, 10 and thread segments 6.1 in a balanced and equalized manner results in a closure shell 5 (top deck and outer skirt) with a very low weight still having a high stiffness to withstand the occurring loading conditions. If appropriate the second and the third recesses 9, 10 may have the same dimensions/cross-sections. If appropriate the second and/or the third recesses can be left away although the overall weight of the closure thereby increases. The recesses 9, 10 preferably have an in general cylindrical or slightly conical shape to increase the axial stiffness and rigidity of the closure shell 5.

The closure 1 comprises on the inside a sealing means 11 which interacts at least with an outer surface 13 and a rim surface 14 of the neck finish 12, when the closure 1 is applied to a neck finish 12 (cross-section in FIG. 6 schematically indicated by dash line). The rim surface 14 interconnects the outer surface 13 with an annular end surface 15.

FIG. 6 shows the seal 11 in a cross-sectional view. The seal is shown in a non-deformed manner. As it can be seen the seal 11 comprises in the shown embodiment an outer leg 16 with an in general constant thickness. The outer leg 16 is separated by a gap 33 from the outer skirt 3. The gap 33 allows that the outer leg to be deformed freely in a radial direction. Under normal circumstances no interaction with the outer skirt is foreseen. An inner side wall 17 of the outer leg 16 is arranged perpendicular or at an angle $\alpha$ pointing slightly radial inwardly. Good results are achieved when the angle $\alpha$ is in a range between 85°-90°. Larger angles may reduce the effectiveness of the seal, because they are difficult to produce and therefore tend to be distorted while ejection of the closure out of the mold. In the shown embodiment the inner side wall 17 merges at the lower end of the outer leg 16 into a herein toroidal lead-in surface 18 having a first radius R1. Alternatively or in addition, the lead-in surface 18 may be funnel shaped. The lead-in surface 18 helps to apply the outer leg 16 onto the neck finish 12. When applied onto the neck finish 12, the outer leg 16 forms a first sealing area with the outer surface 13 of the neck finish 12.

On the outside, the outer leg 16 comprises an outer side wall 19, which is arranged in general parallel to the inner side wall 17. Versus the lower end of the outer leg 16, the outer side wall merges into an outer transition surface 20, which has in the shown embodiment a circular cross-section with a second radius R2, which is depending on the field of application in the range of 0.25 mm to 1.5 mm.

At the inner rear end of the outer leg 16, a bump 21 is visible which is designed and arranged such that when the closure is applied onto the neck finish 12 the bump 21 interacts with the rim surface 14 forming a second sealing area. The bump 21 is functionally separated from the outer leg 16 by a notch 22. The functional interaction between the outer seal 16 and the bump 21 can be adjusted by the shape of the notch 22. In a preferred embodiment the notch 22 has a depth in the range of 0.1 to 0.3 mm. In the shown embodiment the bump 21 has a toroidal shape with a radius preferably in the range of 0.1 to 0.5 mm. The notch 22 avoids unwanted interaction between the outer leg 16 and the bump 21 when deformation of the shell of the closure 1 occurs.

As it can be seen in FIG. 6, the sealing means 11 further comprises a bore seal 36 having a cross-section consisting of an inner leg 23, which reaches into the neck finish 12 when the closure is applied on the neck finish 12 and acts as a bore seal. The inner leg 23 has a protrusion 24 extending radial outwardly and forming in applied position a third sealing area between the sealing means 11 and the neck finish 12. The bore seal 36 may have different shapes depending on the field of application. The bore seal 36 comprises a series of grooves 37 (see FIG. 3) arranged at the lower free end of the bore seal 36. The grooves are 37 which are foreseen to improve venting of the closure during opening in that the gas stored inside the container can be released more quickly.

If appropriate, the herein shown sealing means 11 can be used with a different closure shell although this will result in a less efficient solution with a higher material consumption.

Figure 7:
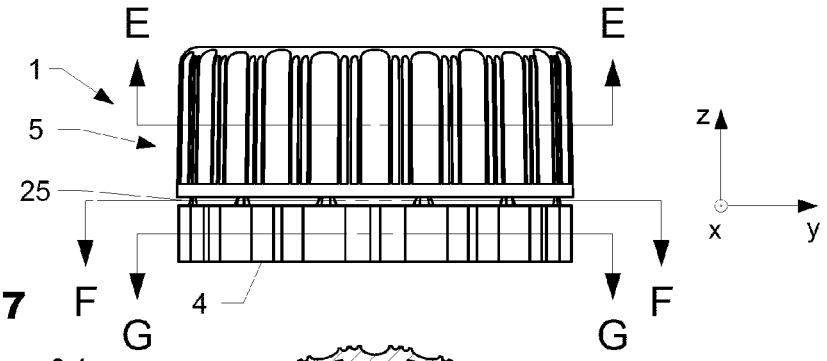
FIG. 7 The closure according to FIG. 1 in a side view.
Figure 8:
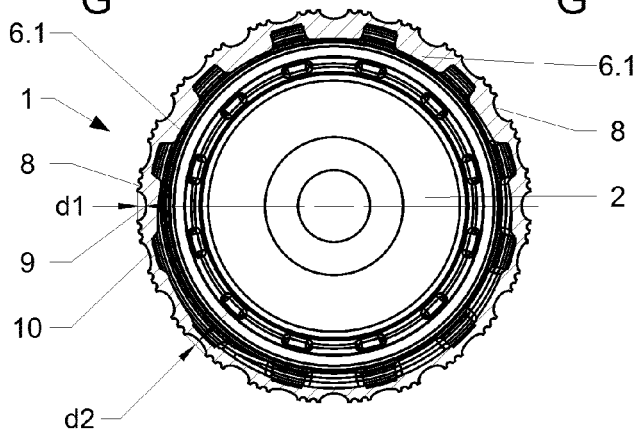
FIG. 8 The closure according to FIG. 7 in a section view along section line E-E.
Figure 9:
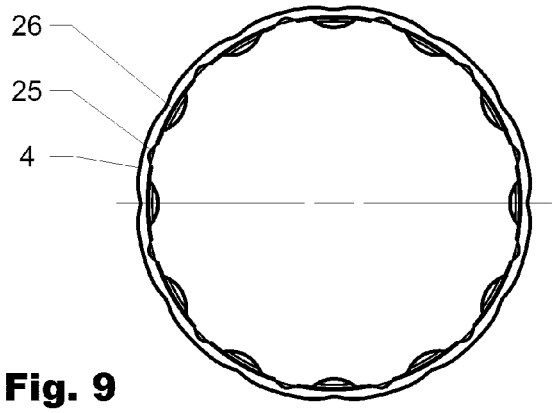
FIG. 9 The closure according to FIG. 7 in a section view along section line F-F.
Figure 10:
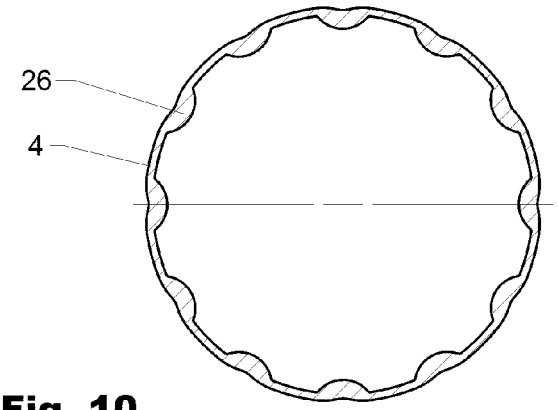
FIG. 10 The closure according to FIG. 7 in a section view along section line G-G.

As it can be best seen in FIGS. 5, 7 and 9 the tamper band 4 is interconnected to the closure shell 5 by frangible bridges 25 which are integrally formed when making of the closure 1. The frangible bridges are pyramidal shaped with a tip arranged in the direction of the skirt 3. Depending on the field of application and the performance of the closure alternatively the frangible bridges can be made by a scoring process. The tamper band 4 comprises on the inside radial inwardly directed protrusions 26 which are foreseen to latch with a corresponding bead (not shown in detail) on the neck finish. As it can be seen in FIG. 9 and the sectional view according to FIG. 10, the protrusions 26 are having in the shown embodiment in a top view an in general circular cross-section.

As it can be seen best in FIG. 5 the frangible bridges 25 are arranged in-between the protrusions 26 of the tamper band 4 and between the rows of thread segments 6. The frangible bridges are in aligned to the first recesses 7 on the inside of the skirt 3. By this balanced and symmetrical setup in combination with the sealing means compensating the deformation of the outer shell 5 when internal pressure and/or elevated temperatures occur a very light-weight closure can be achieved which still has a superior performance with respect to the closures known from prior art.

As it can be seen in the tamper band 4 according to the embodiment shown in FIG. 5 further weight saving is achieved by skeletonizing of the band, i.e. by fourth and fifth recesses 27, 28 evenly distributed on the circumference of the tamper band 4.

Figure 11:
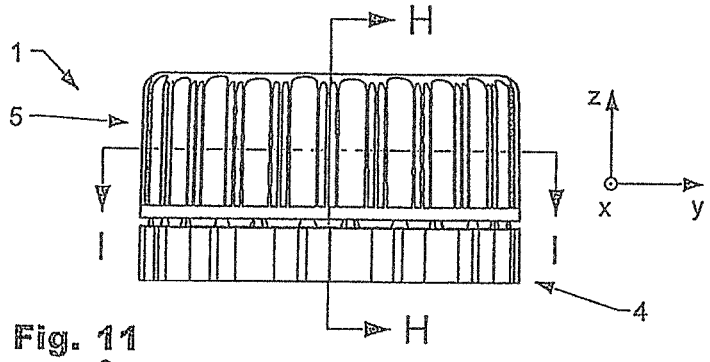
FIG. 11 A second embodiment of a closure according to the invention in a side view.
Figure 12:
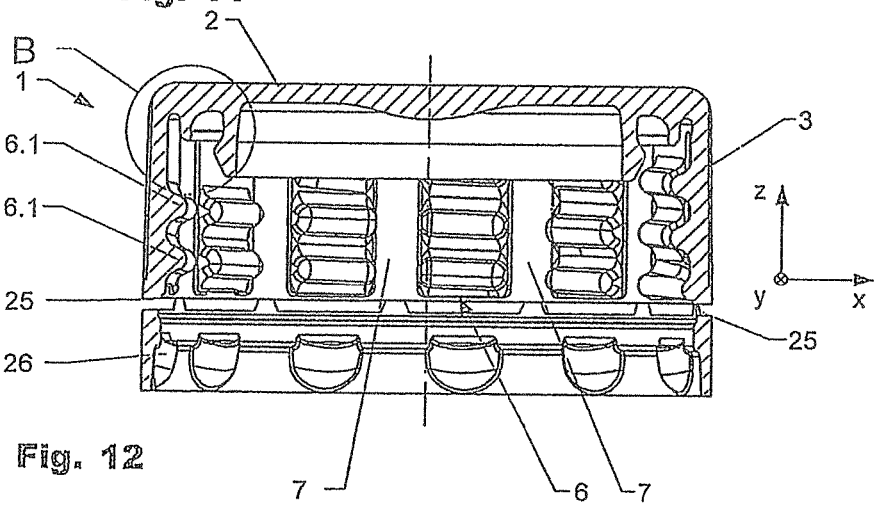
FIG. 12 The closure according to FIG. 11 in a section view along section line H-H.
Figure 13:
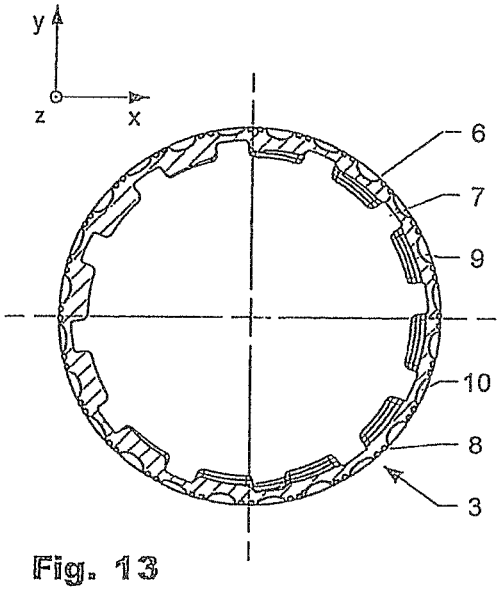
FIG. 13 The closure according to FIG. 11 in a section view along section line I-I.
Figure 14:
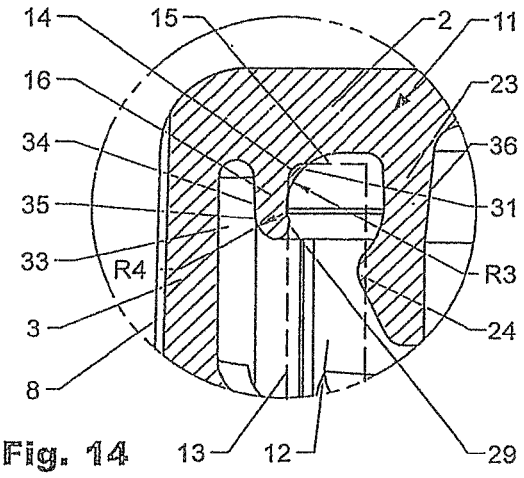
FIG. 14 Detail B according to FIG. 12.

FIG. 11 shows a second embodiment of the closure 1 in a side view. FIG. 12 shows a section view of the closure 1 according to FIG. 11 along section line H-H and FIG. 13 a section view along section line I-I. FIG. 14 shows Detail B according to FIG. 12.

The outer shell 5 of the closure 1 is in general similar to the shell 5 of the closure 1 according to FIGS. 1 through 10. Therefore, regarding the general explanations of these elements it is referred to said drawings. The differences between the closure 1 according to FIGS. 1 through 10 and the closure 1 according to FIG. 11 through 14 are the slightly tamper band 4 and the different sealing means 11.

The sealing means 11 comprises an outer leg 16 which extends in a perpendicular direction (general z-direction) from the top deck 2. The sealing means 11 is shown in an undeformed manner. The outer leg 16 is separated by a gap 33 from the outer skirt 3 and in general free-standing, i.e. no contact with the outer skirt 3 occurs under normal conditions. The outer leg 16 comprises at its lower end a sealing surface 29 foreseen to interact with the outer surface 13 of the neck finish 12 (dash line) forming a first sealing area 30 when the closure is applied onto neck finish 12. The outer leg 16 comprises at its inner root a blend 31 forming a transition area between the outer leg 16 and the top deck 2. The blend 30 is foreseen to establish a second sealing area 32 with a rim surface 14 of neck finish 12. As it can be seen in FIG. 14 in applied position the rim surface 14 of neck finish 12 may significantly dive into and deform the blend 31. Thereby sealing surface 29 is pulled radial inwardly resulting in an increased sealing force in the first sealing area 30. Due to that effect the negative influence which may occur due to a deformation of the outer shell 5 of the closure 1 can be significantly reduced. In the shown embodiment the blend 31 has a circular shape with a radius R3. The radius is preferably in the range between 0.5 mm to 1.2 mm. In the shown embodiment the radius is 1 mm. In the shown embodiment the sealing surface 29 protrudes above the inner surface of the blend 31 forming the most inner point. On the outside the outer leg 16 is defined by an outer side wall 34 which is arranged in general perpendicular to the top deck 2. At the free end the outer side wall 34 turns into an outer transition surface 35 having a radius R4. The radius R4 is preferably in the range of 0.25 mm to 1.5 mm. The sealing means 11 further comprises a bore seal 36 having a cross-section comprising an inner leg 23 and a protrusion directed in radial outward direction.

LIST OF DESIGNATIONS

R1 First Radius (outer leg 16)
R2 Second Radius (outer leg 16)
R3 Third Radius (outer leg 16)
R4 Fourth Radius (outer leg 16)
d1 First Depth (second recess 9)
d2 Second Depth (third recess 10)
1 Closure
2 Top Deck
3 Outer skirt; skirt
4 Tamper Band
5 Closure shell (Top Deck 2+Outer Skirt 3)
6 Thread (6.1: Thread Segments; 6.2: Thread Start Segment)
7 Channel-like first recess; first recess
8 Knurls
9 Channel-like second recesses
10 Channel-like third recesses
11 Sealing means (Seal)
12 Neck finish
13 Outer surface of neck finish
14 Rim surface of neck finish
15 Annular end surface
16 Outer Leg
17 Inner side wall
18 Lead-in surface
19 Outer side wall
20 Outer transition surface
21 Bump
22 Notch
23 Inner leg (bore seal)
24 Protrusion (inner leg)
25 Frangible bridge
26 Protrusion (tamper band)
27 Fourth recess (inside tamper band)
28 Fifth recess (outside tamper band)
29 Sealing surface (outer leg)
30 First sealing area
31 Blend (outer leg)
32 Second sealing area
33 Gap
34 Outer side wall (outer leg 16)
35 Outer transition surface
36 Bore seal
37 Groove (bore seal)

What is claimed is:

1. A closure including:

a top deck and b. a therewith adjacent outer skirt, c. said outer skirt comprising on an inside a segmented thread with thread segments protruding radially inwardly above the inside of the outer skirt whereby d. a first recess arranged between two adjacent thread segments in a circumferential direction on the inside of the outer skirt extending in an axial direction of the skirt and whereby e. second recesses are arranged on the outside of the outer skirt which are recessed relative to said outside of said outer skirt and extend in the axial direction of the outer skirt, whereby each of said second recesses are arranged radial outside to and aligned with at least two thread segments adjacent to each other in an axial direction (z) of the closure, and whereby said second recesses are centered with the at least two thread segments in the circumferential direction, and wherein at least one frangible bridge is in the circumferential direction aligned with one of said first recess.

2. The closure according to claim 1, wherein the second recesses are arranged symmetric with respect to the adjacent thread segments.

3. The closure according to claim 1, wherein the second recesses and the adjacent thread segments are arranged in a symmetric manner with respect to each other.

4. The closure according to claim 1, wherein between two second recesses a third recess is arranged.

5. The closure according to claim 1, wherein on the inside of the outer skirt in circumferential direction 10-15 rows of thread segments and first recesses are arranged.

6. The closure according to claim 5, wherein outside of each row of thread segments one of said second recesses is arranged.

7. The closure according to claim 6, wherein the second recesses are arranged coaxial to the rows of thread segments.

8. The closure according to claim 1, wherein at least one protrusion of a tamper band is in the circumferential direction aligned with one of said thread segments.

9. The closure according claim 1, wherein a sealing means is arranged en the inside of the closure and wherein the sealing means with respect to its cross-section comprises an outer leg extending in general perpendicular from the top deck of the closure and being arranged such that the outer leg in an applied position of the closure on a neck finish interacts with an outer surface of the neck finish forming a first sealing area.

10. The closure according to claim 9, wherein the sealing means comprises a bump arranged at the inner root of the outer leg to interact with a rim surface and/or an annular end surface of the neck finish forming a second sealing area, whereby the bump seal is functionally separated from the outer leg by a notch.

11. The closure according to claim 9, wherein a blend is arranged between the outer leg and the top, which acts as a second sealing area, wherein the blend is designed such that it provides a functional interaction between the outer leg and the second sealing area.

12. The closure according to claim 11, wherein the blend has a concave shape with respect to its cross-section.

13. The closure according to claim 1, wherein the at least one frangible bridge is made by a scoring process.

14. The closure according to claim 13, wherein a tamper band is interconnected to the closure shell by the at least one frangible bridge.

15. The closure according to claim 1, wherein a tamper band is interconnected to the closure shell by the at least one frangible bridge.

16. The closure according to claim 1, wherein said closure consists essentially of an equal number of the first recesses on the inside of the outer skirt and rows of the second recesses on the outside of the outer skirt.

17. The closure according to claim 1, wherein there are two second recesses for every first recess.

18. The closure according to claim 1, wherein the second recesses are recessed and concave relative to the outside of the outer skirt.

* * * * *